US008699926B2

(12) United States Patent
Kunihiro

(10) Patent No.: US 8,699,926 B2
(45) Date of Patent: Apr. 15, 2014

(54) DEVELOPING DEVICE AND IMAGE FORMING APPARATUS INCLUDING THE DEVELOPING DEVICE

(75) Inventor: Hisashi Kunihiro, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 260 days.

(21) Appl. No.: 13/214,360

(22) Filed: Aug. 22, 2011

(65) Prior Publication Data

US 2012/0051798 A1 Mar. 1, 2012

(30) Foreign Application Priority Data

Aug. 27, 2010 (JP) ..... 2010-191221

(51) Int. Cl.
*G03G 15/09* (2006.01)

(52) U.S. Cl.
USPC ..... 399/274

(58) Field of Classification Search
USPC ..... 399/229, 274, 275, 276, 277
See application file for complete search history.

(56) References Cited

U.S. PATENT DOCUMENTS 4,876,574 A * 10/1989 Tajima et al. ..... 399/275
6,021,297 A * 2/2000 Campbell et al. ..... 399/284
6,175,708 B1 1/2001 Ohashi et al.
6,456,810 B1 * 9/2002 Deguchi et al. ..... 399/254
2007/0248380 A1 * 10/2007 Iwamoto et al. ..... 399/130
2009/0152176 A1 * 6/2009 Kipp et al. ..... 209/562
2009/0245888 A1 * 10/2009 Akedo ..... 399/276

FOREIGN PATENT DOCUMENTS

JP 5-011617 A 1/1993
JP 5-171363 A 7/1993
JP 11-161007 6/1999
JP 2000-122415 A 4/2000
JP 2000-137381 5/2000
JP 2001-34066 2/2001
JP 2001-42642 2/2001
JP 2007-232841 9/2007
JP 2008116685 A * 5/2008
JP 2008-250017 10/2008
JP 2009-221555 A 10/2009

* cited by examiner

*Primary Examiner* — David Gray
*Assistant Examiner* — Thomas Giampaolo, II
(74) *Attorney, Agent, or Firm* — Nixon & Vanderhye P.C.

(57) ABSTRACT

A developing device 2 includes a control member 116 for controlling an amount of a developer supplied to an image bearing member 3 by causing a developer captured on a surface of a developing sleeve 119 to be uniform in layer thickness. The control member 116 is arranged to face, via the developing sleeve 119, one (120*b*) of a plurality of magnetic poles provided inside the developing sleeve 119. Further, the control member 116 is arranged to be in parallel with a developing roller 114 in an axial direction of a magnet fixing shaft 126. The control member 116 is such a non-magnetic member that the nearest part of the non-magnetic member from the developing roller 114 has been caused to be ferromagnetic and has been magnetic-field oriented.

7 Claims, 9 Drawing Sheets

DEVELOPING DEVICE AND IMAGE FORMING APPARATUS INCLUDING THE DEVELOPING DEVICE

This Nonprovisional application claims priority under 35 U.S.C. §119(a) on Patent Application No. 2010-191221 filed in Japan on Aug. 27, 2010, the entire contents of which are hereby incorporated by reference.

TECHNICAL FIELD

The present invention relates to a developing device and an image forming apparatus including the developing device. The present invention particularly relates to (i) a developing device employing a two-component developer containing a toner and a magnetic carrier, which developing device is employed in an image forming apparatus (such as an electrostatic copier, a laser printer, and a facsimile device) which forms an image by use of a toner by an electrophotographic technology, and (ii) an image forming apparatus including the developing device.

BACKGROUND ART

There has been conventionally known an electrophotographic image forming apparatus, such as a copier, a printer, and a facsimile device. The electrophotographic image forming apparatus forms an electrostatic latent image on a surface of a toner image bearing member, and then supplies a toner to the toner image bearing member by the developing device. This develops the electrostatic latent image so that a toner image is obtained. After that, the toner image formed on the toner image bearing member is transferred to a sheet such as paper, and then the toner image is fixed on the sheet by a fixing device.

The image forming apparatus employing such an electrophotographic technology, particularly, a full-color image forming apparatus or a high-definition image forming apparatus, often uses a two-component developer (hereinafter, merely referred to as "developer") which is excellent in charge stability of a toner. The two-component developer contains a toner and a carrier. Friction is caused between the toner and the carrier while the two-component developer is stirred in the developing device. The friction allows the toner to be appropriately charged.

In the developing device, the developer is supplied on a surface of a developer carrying member (developing roller), and is caused to be uniform in thickness by a thickness control member. Then, the developer is carried to a developing region where the developer carrying member faces a toner image bearing member. In the developing region, a charged toner in the developer is transferred, by electrostatic force, to an electrostatic latent image formed on the toner image bearing member. This forms a toner image on the surface of the toner image bearing member in accordance with the electrostatic latent image.

These days, there is demand that an image forming apparatus be improved in image quality and energy saving property. In view of this, (i) a carrier having a small diameter in a range of 30 μm to 50 μm or (ii) a toner having a small diameter in a range of 5 μm to 7 μm and a low softening temperature are now used. However, a developer containing a carrier and a toner whose diameters are small is likely to congregate due to heat or stress.

In view of the problems, the following techniques have been proposed to reduce the stress on the developer.

For example, there has been proposed a developing device including a thickness control plate for causing the developer supplied on the surface of the developer carrying member to be uniform in thickness, which thickness control plate is constituted by a magnetic member and a non-magnetic member so as to (i) reduce the stress on the developer and (ii) stably ensure image quality (see Patent Literature 1). Further, there has been proposed such a technique that a magnetic member and a non-magnetic member are integrally formed with high accuracy by employing a laser welding technology (see Patent Literature 2).

Further, there has been proposed a developing device having another arrangement in which a rotatable developer control sleeve in which a magnet roller is provided is placed to face a developer carrying member (see Patent Literatures 3 and 4).

CITATION LIST

Patent Literature

Patent Literature 1
Japanese Patent Application Publication, Tokukaihei, No. 11-161007 A (1999) (Publication Date: Jun. 18, 1999)
Patent Literature 2
Japanese Patent Application Publication, Tokukai, No. 2000-137381 A (Publication Date: May 16, 2000)
Patent Literature 3
Japanese Patent Application Publication, Tokukai, No. 2001-42642 A (Publication Date: Feb. 16, 2001)
Patent Literature 4
Japanese Patent Application Publication, Tokukai, No. 2001-34066 A (Publication Date: Feb. 9, 2001)

SUMMARY OF INVENTION

Technical Problem

In a case where the aforementioned thickness control plate (control member) in which the magnetic member and the non-magnetic member are combined with each other is employed, it is important to ensure (i) accuracy in aligning an end of the magnetic member and an end of the non-magnetic member with respect to each other, and (ii) an appropriate positional relationship between the thickness control plate and a magnetic pole facing the thickness control member, which magnetic pole is provided inside the developing sleeve of the developer carrying member. In this case, ensuring the accuracy in aligning these members or managing assembly conditions causes an increase in production cost of a finished product.

Further, with the arrangement in which the developer control sleeve is provided, it is necessary for the developing device to ensure, inside the developing device, a space for the developer control sleeve. This causes the developing device to be larger. Furthermore, this arrangement has such a problem that the developing device is likely to be clogged with the developer.

The present invention is made in view of the problem. An object of the present invention is to provide a developing device which can (i) reduce stress on a developer with a simple arrangement and (ii) have high productivity without an increase in production cost. Further, another object of the present invention is to provide an image forming apparatus which can provide an image while stably ensuring image quality by suppressing deterioration of a developer by reducing stress on the developer.

Solution to Problem

A developing device of the present invention, for attaining the object, and an image forming apparatus including the developing device are described below.

A developing device of the present invention, includes: a developing tank for containing a developer including a toner and a carrier; a developing roller including a developing sleeve and a magnet roller, the developing sleeve (i) being provided rotatable and (ii) having a cylinder shape, the magnet roller being constituted by a plurality of magnetic poles, the plurality of magnetic poles being fixed to a fixing shaft inside the developing sleeve so that neighboring ones of the plurality of magnetic poles have opposite magnetic polarities, the developing roller (I) capturing, on a surface of the developing sleeve, by magnetic force of the magnet roller, the developer contained in the developing tank, and (II) supplying the developer captured on the surface of the developing sleeve to an image bearing member which is provided to face the developing roller; and a control member for controlling an amount of the developer to be supplied to the image bearing member by causing the developer captured on the surface of the developing sleeve to be uniform in layer thickness, the control member being provided to face, via the developing sleeve, one of the plurality of magnetic poles, the control member being a non-magnetic member provided in parallel with the developing roller in an axial direction of the fixing shaft, the non-magnetic member being such that a nearest part of the non-magnetic member from the developing roller (i) has been caused to be ferromagnetic and (ii) has been magnetic-field oriented.

Advantageous Effects of Invention

According to the arrangement, the control member for controlling the amount of the developer to be supplied to the developing sleeve is a non-magnetic member, and is arranged to face, via the developing sleeve, one of the plurality of magnetic poles provided inside the developing sleeve. The nearest part (end section) of the non-magnetic member from the developing roller (i) has been caused to be ferromagnetic and (ii) has been magnetic-field oriented. For this reason, a mass of the control member has no influence on a magnetic field between the control member and the one of the plurality of magnetic poles. This makes it possible to prevent generation of phenomena such as torque-up and toner-spent. Note that, in a case where the entire control member is made of a magnetic material, magnetic force of the one of the plurality of magnetic poles, facing the control member, has an influence on even parts other than the nearest part (end section). In this case, flow of the developer becomes less fluent, and therefore torque-up is generated.

Further, the control member is arranged to be in parallel with the axial direction of the fixing shaft of the developing roller. This makes it possible to efficiently cut off an excess developer among the developer provided on the surface of the developing sleeve so that the developer on the surface of the developing roller becomes uniform in thickness after passing the control member.

As is clear from the above descriptions, according to the arrangement of the present invention described above, it is possible to provide a developing device which can (i) reduce (suppress) stress on a developer with a simple arrangement and (ii) have high productivity without an increase in production cost. Further, by employing the developing device having the above arrangement, it is possible to suppress deterioration of the developer. This makes it possible to provide images while stably ensuring image quality for a long term.

DESCRIPTION OF EMBODIMENTS

One embodiment of the present invention is described below with reference to drawings.

<Image Forming Apparatus>

Figure 2:
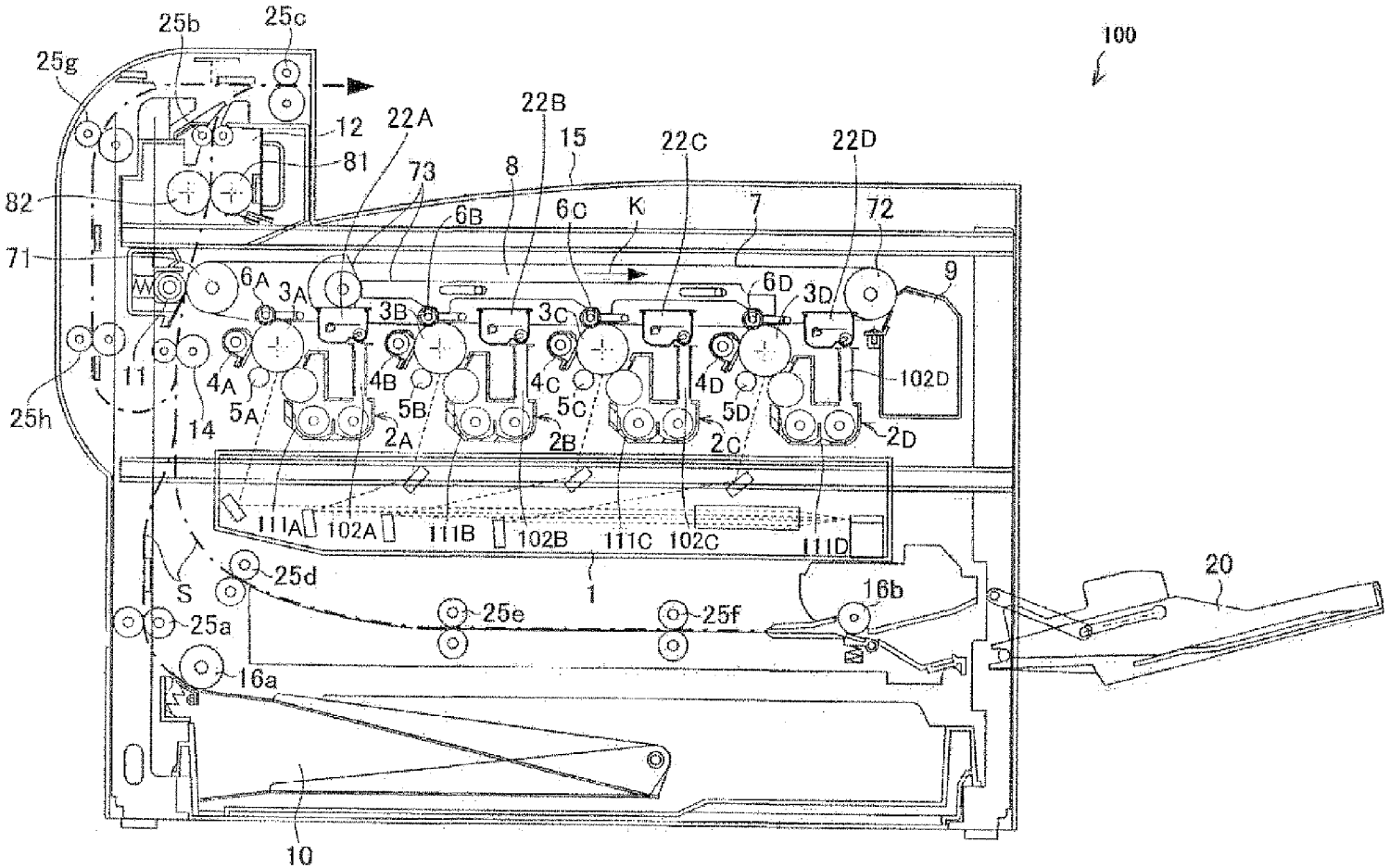
FIG. 2 is an explanatory view illustrating an entire arrangement of the image forming apparatus.

First, the following description deals with an entire configuration of an image forming apparatus employing a developing device in accordance with the present embodiment. FIG. 2 is a cross-sectional view schematically illustrating a configuration of an image forming apparatus 100 in accordance with the present embodiment. The image forming apparatus 100 forms an image by use of a toner in accordance with an electrophotographic technique.

The following embodiment describes a case where the image forming apparatus of the present invention is applied to a color-tandem-type image forming apparatus 100 for forming, in accordance with image data, received from the outside, a multicolor image or a monochromatic image on a recording material, such as recording paper, a recording film, or a recording sheet. Note, however, that the present invention is not limited to this, and is applicable to any image forming apparatus, provided that it includes a developing device of the present invention described later.

The image forming apparatus 100 includes an exposure unit (exposure device) 1, four image forming stations (image forming sections) 31A through 31D, an intermediate transfer belt unit (transfer device) 8, a transfer roller 11, a fixing unit (fixing device) 12, an internal paper feeding tray 10, a manual paper feeding tray 20, a sheet carrying path S, and a paper output tray 15 (see FIG. 2). Further, a scanner and the like can be additionally provided above the image forming apparatus 100. Note that each operation of the members provided in the image forming apparatus 100 is controlled by a main control section constituted by a CPU (not illustrated) and the like.

The image forming apparatus 100 forms a black image, a cyan image, a magenta image, and a yellow image by use of respective color components of black (K), cyan (C), magenta (M), and yellow (Y), and forms a color image by causing the images of the color components to overlap each other.

Accordingly, the image forming apparatus 100 includes, for the images of the respective four color components, four developing devices 2 (2A, 2B, 2C, 2D), four photoreceptors (image bearing members) 3 (3A, 3B, 3C, 3D), four chargers (charging devices) 5 (5A, 5B, 5C, 5D), and four cleaner units 4 (4A, 4B, 4C, 4D) (see FIG. 2). In other words, for each of the color components CMYK, one image forming station 31 (31A, 31B, 31C, 31D) including one developing device 2, one photoreceptor 3, one charger 5, and one cleaner unit 4, is provided. Four toner ages are formed by the respective image forming stations 31A through 31D, and are caused to overlap each other on the intermediate transfer belt 7.

Note that the sign "A" indicates a member for forming a black image, the sign "B" indicates a member for forming a cyan image, the sign "C" indicates a member for forming a magenta image, and the sign "D" indicates a member for forming a yellow image. Note that, in the present embodiment, members that (i) are provided for formation of the respective black, cyan, magenta, and yellow images but (ii) are identical with each other in function are not provided with the signs A through D but with only numbers, for the sake of simple explanation.

The image forming station 31 has an arrangement in which (i) the photoreceptor 3 is provided as being rotatable and (ii) the charger 5, the developing device 2, and the cleaner unit 4 are provided, in this order, along a periphery of the photoreceptor in a rotational direction of the photoreceptor 3.

The charger 5 uniformly charges an entire surface of the photoreceptor 3 at a certain electric potential. In addition to a contact-roller charger illustrated in FIG. 2, examples of the charger 5 encompass a contact-brush charger and a non-contact charger.

The developing device 2 carries out a developing process for making an electrostatic latent image formed on the surface of the photoreceptor 3 visible by use of a toner. The developing device 2 includes a toner transfer mechanism 102 (102A, 102B, 102C, 102D), a toner supply device 22 (22A, 22B, 22C, 22D), and a developing tank (developer container) 111 (111A, 111B, 111C, 111D).

The toner supply device 22 in which an unused toner (toner powder) is stored is provided above the developing tank 111. The toner is supplied from the toner supply device 22 to the developing tank 111 via the toner transfer mechanism 102.

The cleaner unit 4 removes a residual toner that remains on the surface of the photoreceptor 3 after the toner image is transferred to the intermediate transfer belt 7, so as to collect the residual toner.

The exposure unit 1 causes the photoreceptor 3 charged by the charger 5 to be exposed in accordance with image data, so as to form an electrostatic latent image on a surface of the photoreceptor 3 in accordance with the image data. The exposure unit 1 is a laser scanning unit (LSU) including a laser illumination section and a reflecting mirror (see FIG. 2). Note, however, that, the exposure unit 1 is not limited to the laser scanning unit, and may be an EL (electroluminescence) element in which light emitting elements are arrayed, or an LED writing head. The exposure unit 1 causes the photoreceptor 3 charged by the charger 5 to be exposed in accordance with image data inputted into the image forming apparatus 100, so as to form an electrostatic latent image on the surface of the photoreceptor 3 in accordance with the image data.

The intermediate transfer belt unit 8 is provided above the photoreceptor 3. The intermediate transfer belt unit 8 includes intermediate transfer rollers 6 (6A, 6B, 6C, 6D), an intermediate transfer belt 7, an intermediate transfer belt driving roller 71, an intermediate transfer belt driven roller 72, an intermediate transfer belt tension mechanism 73, and an intermediate transfer belt cleaning unit 9.

The intermediate transfer rollers 6, the intermediate transfer belt driving roller 71, the intermediate transfer belt driven roller 72, and the intermediate transfer belt tension mechanism 73 are arranged so as to (i) cause the intermediate transfer belt 7 to be in a tensioned state and (ii) drive the intermediate transfer belt 7 to rotate in a direction indicated by an arrow K shown in FIG. 2.

The intermediate transfer rollers 6 are rotatably held by respective intermediate transfer roller attachment sections of the intermediate transfer belt tension mechanism 73 of the intermediate transfer belt unit 8. A transfer bias voltage is applied to each of the intermediate transfer rollers 6 so that a toner image formed on the corresponding photoreceptor 3 is transferred to the intermediate transfer belt 7.

The intermediate transfer belt 7 is in contact with the photoreceptor 3. Toner images for the respective color components, formed on the respective photoreceptors 3, are sequentially transferred onto the intermediate transfer belt 7 so that the toner images overlap each other. A color toner image (multicolor toner image) is formed in this manner. The intermediate transfer belt 7 is made of a film having a thickness in a range of 100 μm to 150 μm, for example, and has a shape having no ends.

The transfer of the toner image from the photoreceptor 3 to the intermediate transfer belt 7 is carried out by the intermediate transfer roller 6 that is in contact with a back surface of the intermediate transfer belt 7. The transfer bias voltage is applied to the intermediate transfer roller 6 so as to transfer the toner image to the intermediate transfer belt 7. The transfer bias voltage is a high voltage having a magnetic polarity (+) opposite to a magnetic polarity (−) of the charging of the toner.

The intermediate transfer roller 6 has a metal (stainless steel, for example) shaft having a diameter in a range of 8 mm to 10 mm, for example, which metal shaft serves as a base of the intermediate transfer roller 6. A surface of the intermediate transfer roller 6 is covered with a conductive elastic material (e.g., an EPDM or urethane foam). The conductive elastic material allows the intermediate transfer roller 6 to uniformly apply a high voltage to the intermediate transfer belt 7. According to the present embodiment, the intermediate transfer roller 6 having a roller shape is used as a transfer electrode. Note, however, that the intermediate transfer roller 6 is not limited to this, and may have a brush shape.

As described above, electrostatic latent images formed on the respective the photoreceptors 3A through 3D are made visible by use of toners corresponding to the respective color components. In this manner, the toner images are generated. These toner images are caused to overlap and be stacked with each other on the intermediate transfer belt 7. The toner images stacked with each other are carried, by rotation of the intermediate transfer belt 7, to a contact position (transfer section) between a recoding material being carried and the intermediate transfer belt 7. The toner images are transferred onto the recording material at the contact position by the transfer roller 11 provided at the contact position. In this case, the intermediate transfer belt 7 and the transfer roller 11 are pressed against each other at a predetermined nip pressure, while a voltage for transferring the toner images to the recording material is applied to the transfer roller 11. The voltage is a high voltage having a magnetic polarity (+) opposite to a magnetic polarity (−) of the charging of the toner.

In order to maintain the predetermined nip pressure, one of the transfer roller 11 and the intermediate transfer belt driving roller 71 is made from a hard material such as a metal, while the other is made from an elastic material such as an elastic roller (e.g., an elastic rubber roller or a foamable resin roller).

The toner that has been provided on the intermediate transfer belt 7 by a physical contact between the intermediate transfer belt 7 and the photoreceptor 3 but has not been transferred to the recording material from the intermediate transfer belt 7 may cause a color mixture of toners in a subsequent step. Therefore, such a residual toner is removed and collected by the intermediate transfer belt cleaning unit 9.

The intermediate transfer belt cleaning unit 9 includes, for example, a cleaning blade that is in contact with the intermediate transfer belt 7. A back surface of the intermediate transfer belt 7 is supported by the intermediate transfer belt driven roller 72 at a position where the intermediate transfer belt 7 is in contact with the cleaning blade.

In the internal paper feeding tray 10, the recording material (the recording paper, the recording film, the recording sheet) on which an image is to be formed is stored. According to the present embodiment, the internal paper feeding unit tray 10 is provided below the image forming stations 31A through 31D and the exposure unit 1. Further, the manual paper feeding tray 20 is foldably provided on a side wall of the image forming apparatus 100. The manual paper feeding tray 20 is used when the recording material is fed manually. Meanwhile, the paper output tray 15 provided at an upper part of the image forming apparatus 100 is a tray to which a recording material on which an image has been formed is to be outputted.

Further, the image forming apparatus 100 includes a sheet carrying path S through which the recording material stored in the internal paper feeding tray 10 and the recording material fed to the manual paper feeding tray 20 are carried to the paper output tray 15 via the transfer section, the fixing unit 12, etc.

Further, the sheet carrying path S is provided with pickup rollers 16 (16*a*, 16*b*), a registration roller 14, the transfer section, the fixing unit 12, a plurality of carrying rollers 25 (25*a* through 25*h*), etc. Note that the transfer section is provided between the intermediate transfer belt driving roller 71 and the transfer roller 11.

Each of the plurality of carrying rollers 25 is a small roller for accelerating and supporting conveyance of the recording material, and is provided along the sheet carrying path S. The pickup roller 16*a* is provided at an end of the internal paper feeding tray 10. The pickup roller 16*a* is a suction roller for supplying the recording material one by one from the internal paper feeding tray 10 to the sheet carrying path S. The pickup roller 16*b* is provided in the vicinity of the manual paper feeding tray 20. The pickup roller 16*b* is a suction roller for supplying the recording material one by one from the manual paper feeding tray 20 to the sheet carrying path S. The registration roller 14 (i) temporarily holds the recording material being carried through the sheet carrying path S, and (ii) supplies the recording material to the transfer section at certain timing so that an end of a toner image formed on the intermediate transfer belt 7 and an end of the recording material match each other.

The fixing unit 12 includes a heat roller 81 and a pressure roller 82. The heat roller 81 and the pressure roller 82 sandwich the recording material and rotate. The heat roller 81 is controlled to be at a predetermined fixing temperature by a control section (not illustrated). The control section controls the temperature of the heat roller 81 on the basis of a detection signal received from a thermometer (not illustrated).

The heat roller 81 carries out, in combination with the pressure roller 82, thermocompression with respect to the recording material so that the toner images of the respective color components are melt, mixed with each other, and provided on the recording material with pressure. Heat-fixing of the toner images to the recording material is carried out in this manner. Note that the recording material on which the toner images of the respective color components (color toner images) are fixed is carried to an inversion paper output path of the sheet carrying path S by the plurality of the carrying rollers 25, and then is inverted (state where the multicolor toner image faces downward), after that, is outputted to the paper output tray 15 in the inverted state.

Next, the following description deals with how a recording material carrying operation is carried out by the sheet carrying path S.

The following description deals with one-side printing. The recording material supplied from the internal paper feeding tray 10 is picked up by the pickup roller 16*a*, and then is carried to the registration roller 14 by the carrying roller 25*a* in the sheet carrying path S, after that, is supplied to the transfer section (the contact position between the transfer roller 11 and the intermediate transfer belt 7) by the registration roller 14 at certain timing so that an end of the recording material and an end of each of the toner images stacked with each other match each other. The toner images are transferred to the recording material at the transfer section, and are fixed on the recording material by the fixing unit 12. Then, the recording material is carried by the carrying roller 25*b*, and then outputted to the paper output tray 15 by the paper output roller 25*c*.

Further, the recording material supplied from the manual paper feeding tray 20 is picked up by the pickup roller 16*b*, and then is carried to the registration roller 14 by the plurality of carrying rollers 25 (25*f*, 25*e*, 25*d*). After being carried to the registration roller 14, the recording material is subjected to the printing and then outputted to the paper output tray 15 in the same manner as the recording material supplied from the internal paper feeding tray 10.

On the other hand, in a case of two-sided printing, the recording material is, first, subjected to the one-side printing as described above, and then is received by the paper output roller 25*c* from the fixing unit 12. A rear end of the recording material is chucked by the paper output roller 25*c*, and then the recording material is led to the carrying rollers 25*g* and 25*h* by inverse rotation of the paper output roller 25*c*. After that, the recording material is carried to the registration roller 14 again, and then is subjected to the printing process for its surface opposite to the surface that has been subjected to the printing. Ultimately, the recording material is outputted to the paper output tray 15.

Next, the following description deals with details of a configuration of the toner supply device 22.

Figure 3:
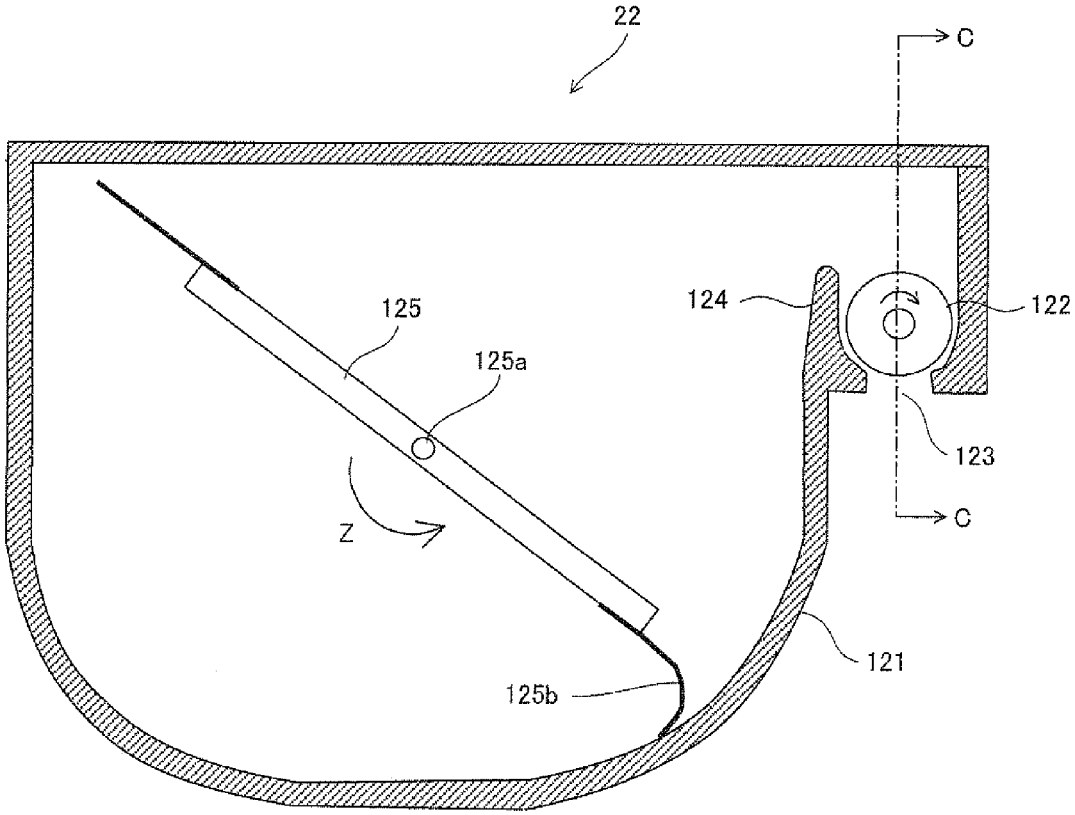
FIG. 3 is a cross-sectional view schematically illustrating a configuration of a toner supply device included in the image forming apparatus.
Figure 4:
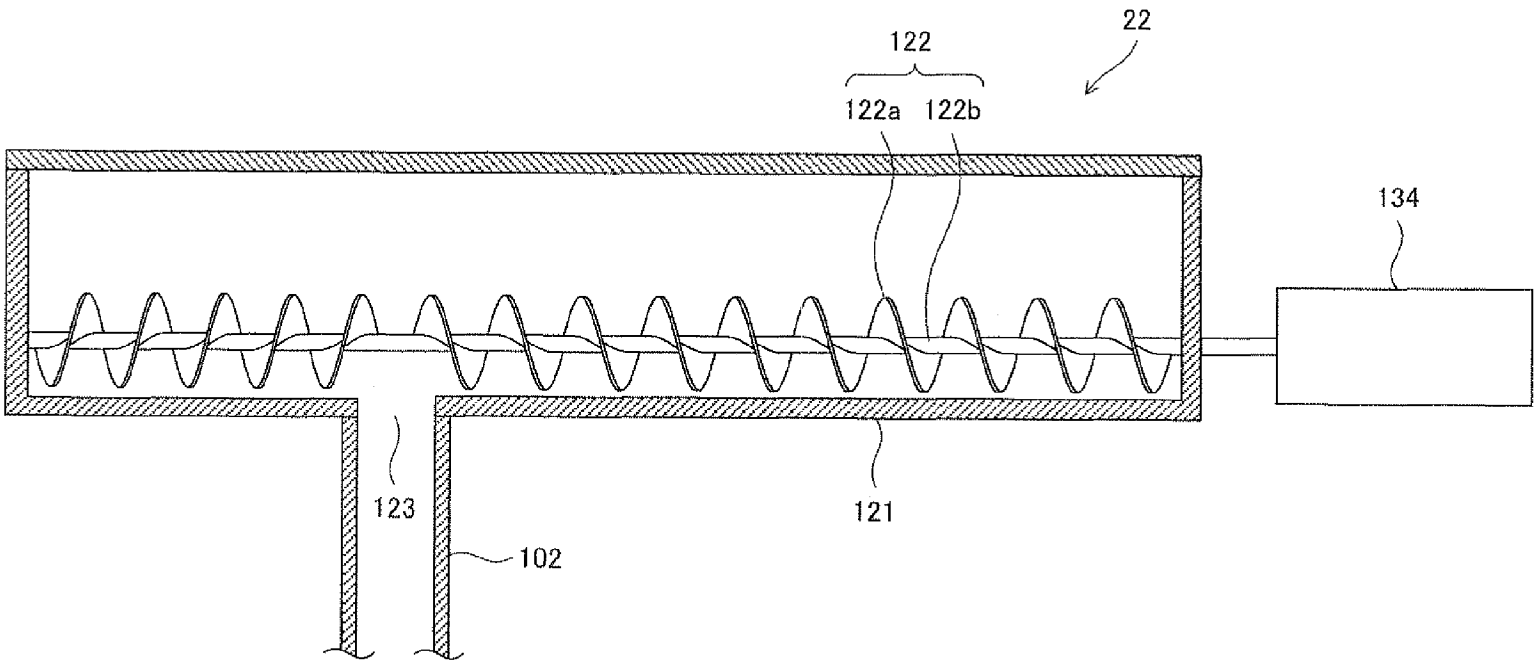
FIG. 4 is a cross-sectional view illustrating the toner supply device illustrated in FIG. 3, taken along the line C-C.

FIG. 3 is a cross-sectional view schematically illustrating the configuration of the toner supply device 22 of the image forming apparatus 100, and FIG. 4 is a cross-sectional view taken along the line C-C shown in FIG. 3.

The toner supply device 22 includes a toner container 121, a toner-stirring member 125, a toner discharge member 122, and a toner discharge opening 123 (see FIG. 3). The toner supply device 22 in which an unused toner (toner powder) is stored is provided above the developing tank 111. The unused toner stored in the toner supply device 22 is supplied, by rotation of the toner discharge member (output screw) 122, to the developing tank 111 via the toner discharge opening 123 and the toner transfer mechanism 102.

The toner container 121 is a container having a columnar shape whose base has a shape substantially identical with a half circle, which columnar shape has an internal space. The toner container 121 has the toner-stirring member 125 and the toner discharge member 122 so that the toner-stirring member 125 and the toner discharge member 122 are rotatable. A toner is stored in the toner container 121. The toner discharge opening 123 is an opening whose shape is substantially identical with a rectangle. The discharge opening 123 is formed (i) below the toner discharge member 122 and (ii) in the vicinity of a center of the toner discharge member 122 in an axial direction of the toner discharge member 122, so as to face the toner transfer mechanism 102.

The toner-stirring member 125 is a plate member which rotates around a rotary shaft 125*a* so as to scoop the toner stored in the toner container 121 up to the toner discharge member 122 while stirring the toner. The toner-stirring member 125 has toner-scooping members 125*b* at its ends, respectively. The toner-scooping members 125*b* are made of, for example, a material having flexibility such as a polyethylene terephthalate (PET), and are attached to respective ends of the toner-stirring member 125.

The toner discharge member 122 supplies the toner stored in the toner container 121 to the developing tank 111 via the toner discharge opening 123. The toner discharge member 122 is constituted by a screw auger including a toner carrying blade 122*a* and a toner discharge member rotary shaft 122*b* (see FIG. 4). The toner discharge member 122 can be driven to rotate by a toner discharge member driving motor 134. The toner carrying blade 122*a* of the screw auger is arranged so that the toner is moved toward the toner discharge opening 123 from both ends of the toner discharge member 122 in the axial direction of the toner discharge member 122.

A toner discharge member blocking wall 124 is provided between the toner discharge member 122 and the toner-stirring member 125. With the arrangement, the toner scooped up by the toner-stirring member 125 is adjusted in an amount so that an appropriate amount of the toner is retained around the toner discharge member 122.

The toner-stirring member 125 rotates in a Z direction shown in FIG. 3 so as to stir the toner and scoop up the toner toward the toner discharge member 122. Here, the toner-scooping members 125*b* have flexibility so as to change their shapes, as sliding along an internal wall of the toner container 121. With the arrangement, the toner scooping members 125*b* can supply the toner toward the toner discharge member 122. The toner discharge member 122 rotates so as to lead the supplied toner to the toner discharge opening 123.

<Developing Device>

Figure 1:
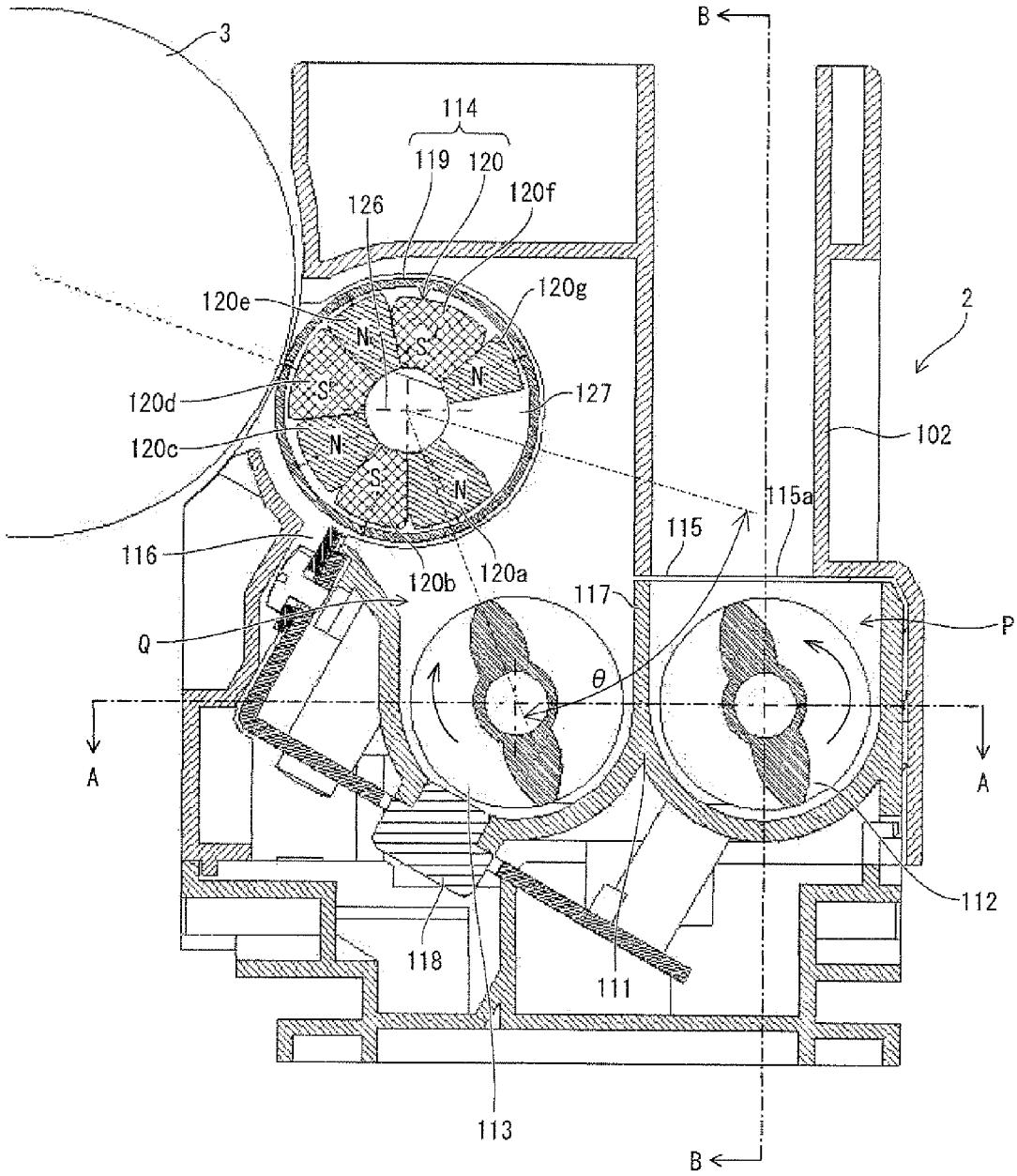
FIG. 1 is a cross-sectional view illustrating a configuration of a developing device included in an image forming apparatus in accordance with an embodiment of the present invention.
Figure 5:
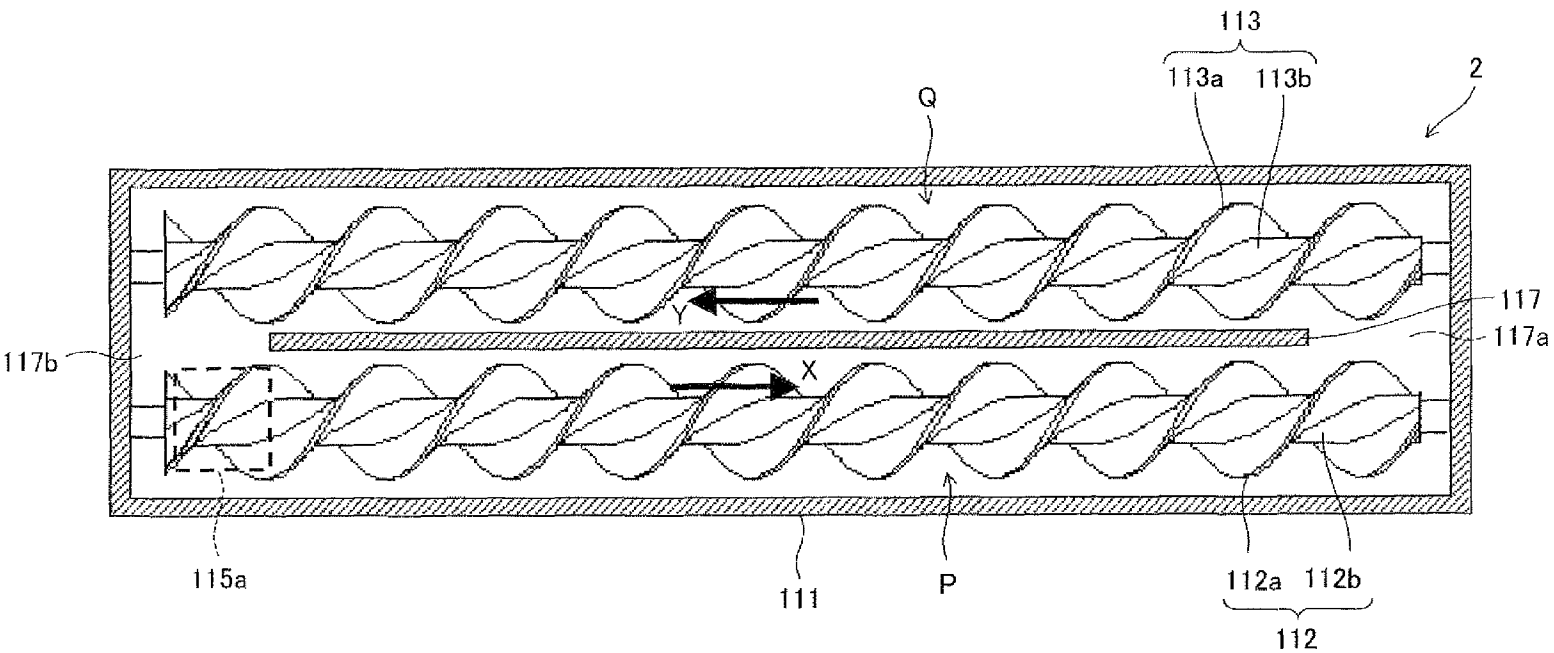
FIG. 5 is a cross-sectional view illustrating the developing device illustrated in FIG. 1, taken along the line A-A.
Figure 6:
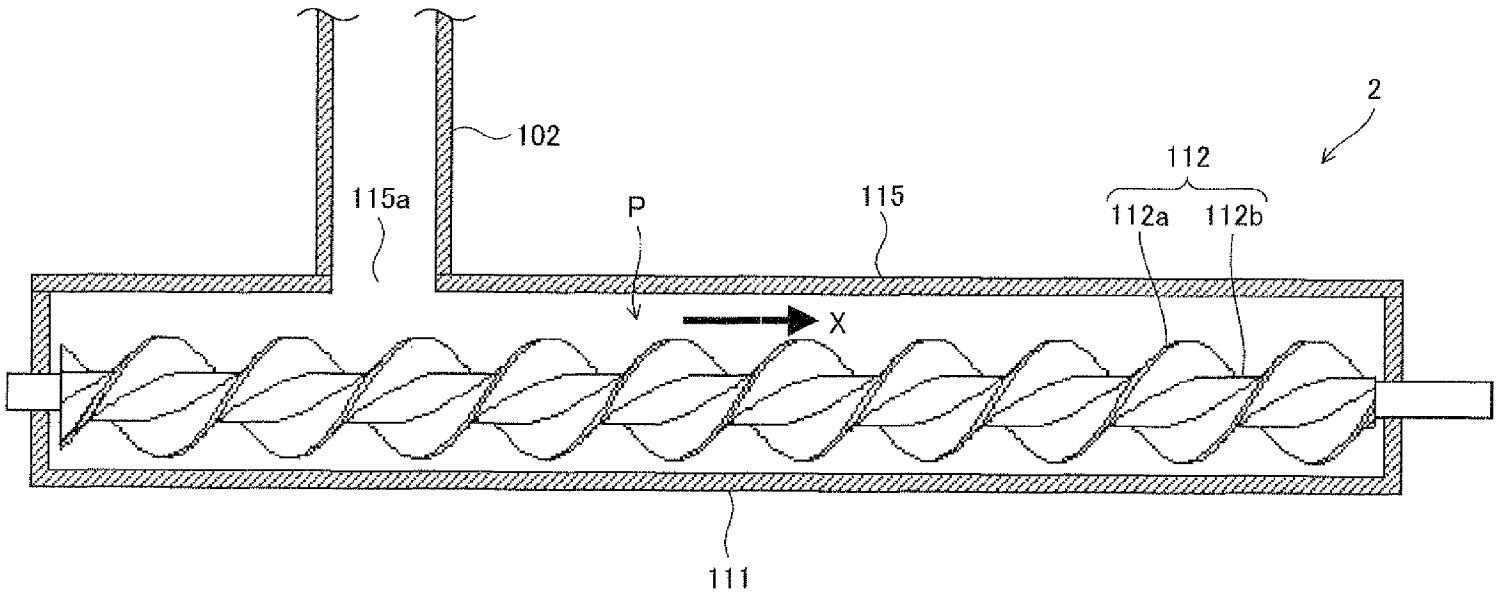
FIG. 6 is a cross-sectional view illustrating the developing device illustrated in FIG. 1, taken along the line B-B.

Next, the following description deals with a characteristic developing device 2 in accordance with the present embodiment, with reference to drawings. FIG. 1 is a cross-sectional view illustrating a configuration of the developing device 2 of the present embodiment, included in the image forming apparatus 100 of the present embodiment. FIG. 5 is a cross-sectional view taken along the line A-A shown in FIG. 1, and FIG. 6 is a cross-sectional view taken along the line B-B shown in FIG. 1.

The developing device 2 includes a developing roller 114 which is provided in the developing tank 111 to face the photoreceptor 3 (see FIG. 1). The developing device 2 supplies, by use of the developing roller 114, a toner to the surface of the photoreceptor 3, so as to make an electrostatic latent image formed on the surface of the photoreceptor 3 visible (developed).

In addition to the developing roller 114 and the developing tank 111, the developing device 2 includes a developing tank cover 115, a toner supply opening 115*a*, a doctor blade (control member) 116, a first carrying member 112, a second carrying member 113, a partition wall 117, and a permeability sensor 118.

The developing tank 111 is a tank for storing a two-component developer including a toner and a carrier (hereinafter, merely referred to as "developer" for the sake of simple explanation). In the developing tank 111, the developing roller 114, the first carrying member 112, the second carrying member 113, and the like are provided.

Note that the carrier used in the present embodiment is a magnetic carrier having magnetism. Specific examples of magnetic particles encompass metal particles such as particles of iron, ferrite, or magnetite, and particles of an alloy of such a metal and a metal such as aluminum or lead. Among these, ferrite particles are particularly preferable. Alternatively, the magnetic particles can be a resin coating carrier in which magnetic particles are coated with a resin, a resin dispersed carrier in which magnetic particles are dispersed in a resin, or the like.

Further, the developing tank cover 115 is provided detachable at an upper part of the developing tank 111 (see FIG. 1). Furthermore, the developing tank cover 115 has a toner supply opening 115*a* via which an unused toner is supplied into the developing tank 111. The toner supply opening 115*a* is connected to the toner transfer mechanism 102 of the toner supply device 22. Accordingly, the unused toner stored in the toner supply device 22 is transferred into the developing tank 111 via the toner transfer mechanism 102 and the toner supply opening 115*a*. The unused toner is supplied into the developing tank 111 in this manner.

In the developing tank 111, the partition wall 117 is provided between the first carrying member 112 and the second carrying member 113 (see FIGS. 1 and 5). The partition wall 117 extends in parallel with (i) an axial direction (a direction in which the rotary shaft extends) of the first carrying member 112 and (ii) an axial direction (a direction in which the rotary shaft extends) of the second carrying member 113. The partition wall 117 partitions an internal space of the developing tank 111 into a first carrying path P in which the first carrying member 112 is provided and a second carrying path Q in which the second carrying member 113 is provided.

The partition wall 117 is provided so that both ends of the partition wall 117 in the axial direction of the first carrying member 112 and the second carrying member 113 are not in contact with any internal side wall of the developing tank 111 (see FIG. 5). That is, in the vicinity of each of the ends of the partition wall 117 in the axial direction of the first carrying member 112 and the second carrying member 113, there is a communicating path via which the first carrying path P and the second carrying path Q are connected. Hereinafter, a communicating path formed on a downstream side of the first carrying path P (downstream in a direction indicated by an arrow X) is referred to as "first communicating path 117*a*", whereas a communicating path formed on a downstream side of the second carrying path Q (downstream in a direction indicated by an arrow Y) is referred to as "second communicating path 117*b*".

The first carrying member 112 and the second carrying member 113 are provided such that (i) their outer surfaces face each other via the partition wall 117 and (ii) their axes are parallel to each other. The first carrying member 112 and the second carrying member 113 are set to rotate in inverse directions with respect to each other. Therefore, the first carrying member 112 and the second carrying member 113 carry the developer in the directions opposite to each other, respectively, while stirring the developer. The first carrying member 112 carries the developer in the direction indicated by the arrow X, whereas the second carrying member 113 carries the developer in the direction indicted by the arrow Y, which is opposite to the direction indicated by the arrow X (see FIG. 5).

The first carrying member 112 is constituted by a screw auger including a first spiral carrying blade 112*a* and a first rotary shaft 112*b* (see FIG. 5). Similarly, the second carrying member 113 is constituted by a screw auger including a second spiral carrying blade 113*a* and a second rotary shaft 113*b*. The first carrying member 112 and the second carrying member 113 are driven by driving means such as a motor (not illustrated) so as to rotate. By the rotation of the first carrying member 112 and the second carrying member 113, the developer is stirred and carried.

The developing roller 114 is provided to face, but not in contact with, the photoreceptor 3 (with a space between them) (see FIG. 1). The developer carried by the developing roller 114 is in contact with the photoreceptor at an area where the developing roller 114 and the photoreceptor 3 are closest to each other. The contact area serves as a developing area (developing nip section). In the developing area, a developing bias voltage is applied to the developing roller 114 from a power source (not illustrated) connected to the developing roller 114, so that the toner is supplied from the developer on the surface of the developing roller 114 to an electrostatic latent image formed on the surface of the photoreceptor 3.

The developing roller 114 includes a developing sleeve 119 and a magnet roller 120 which is provided in the developing sleeve 119 (see FIG. 1). The developing roller 114 (i) scoops the developer in the developing tank 111 to the surface of the developing sleeve 119 by magnetic force of the magnet roller 120, (ii) holds (captured) the developer on the surface of the developing sleeve 119, and then (iii) supplies the toner contained in the developer held on the surface of the developing sleeve to the photoreceptor 3.

The developing sleeve 119 is a circular cylinder member that (i) is made of a nonmagnetic material such as aluminum or stainless steel and (ii) constitutes a periphery part of the developing roller 114. The developing sleeve 119 rotates in one direction (a clockwise direction in FIG. 1) on an outer surface of the magnet roller 120 which is provided in the developing sleeve 119, so as to carry the developer while holding the developer by the magnetic power of the magnet roller 120.

According to the present embodiment, the magnet roller 120 is formed such that 7 magnetic poles (a first magnetic pole 120*a* through a seventh magnetic pole 120*g*) are fixed to a magnet fixing shaft 126. That is, the seven magnetic poles are provided integral with each other. The seven magnetic poles are fixed to the magnet fixing shaft 126 so as to be rotatable, with the same central axis as the developing sleeve 119, in a direction opposite to the direction in which the developing sleeve 119 is rotatable.

The first magnetic pole 120*a* is positioned so as to face the developer that is stirred and carried in the developing tank 111. Specifically, the first magnetic pole 120*a* is provided so as to face the second carrying member 113. The first magnetic pole 120*a* is a scooping magnetic pole for scooping, to the developing sleeve 119, the developer that is stirred and carried by the second carrying member 113 (causing the developer to be captured by (absorbed to) the developing sleeve 119). According to the present embodiment, the first magnetic pole 120*a* is constituted by the north pole. Note that the scooping magnetic pole 120*a* can be the south pole provided that the north poles and the south poles are arranged alternately so that neighboring poles of the first magnetic pole 120*a* through the seventh magnetic pole 120*g* are opposite to each other in magnetic polarity. Furthermore, the number of the magnetic poles is not limited to 7, and can be 5, for example.

During a normal image forming operation, first, the developer provided in the developing tank 111 is scooped toward the developing roller 114 by use of a magnetic line created by the first magnetic pole 120*a*.

The second magnetic pole 120*b* is provided adjacent to the first magnetic pole 120*a* on a downstream side in the rotational direction of the developing sleeve 119 (the clockwise direction in FIG. 1). The second magnetic pole 120*b* is the south pole. The second magnetic pole 120*b* is provided so that the magnetic power of the second magnetic pole 120*b* toward the magnet fixing shaft 126 is substantially strongest in an area where a surface of the developing sleeve 119 faces the doctor blade 116. The developer is scooped up to the surface of the developing sleeve 119 by use of a magnetic line created by the second magnetic pole 120*b*, and then is stably carried to downstream in the rotational direction of the developing sleeve 119. A layer thickness of the developer carried on the surface of the developing sleeve 119 is made uniform by the doctor blade 116.

The third magnetic pole 120*c* is provided adjacent to the second magnetic pole 120*b* on the downstream side in the rotational direction of the developing sleeve 119. The third magnetic pole 120*c* is the north pole. A magnetic line created by the third magnetic pole 120*c* contributes to stable conveyance of the developer on the developing sleeve 119 from the third magnetic pole 120*c* to the downstream forth magnetic pole 120*d* in the rotational direction of the developing sleeve 119, which developer has been made uniform in thickness by the second magnetic pole 120*b* and the doctor blade 116.

The fourth magnetic pole 120*d* is provided adjacent to the third magnetic pole 120*c* on the downstream side in the rotational direction of the developing sleeve 119. The fourth magnetic pole 120*d* is the south pole. The fourth magnetic pole is provided to face the photoreceptor 3, and serves as a main magnetic pole to form an image. The developer carried from the third magnetic pole 120*c* is slid against the photoreceptor 3 by a magnetic brush of the developer, which magnetic brush is created by a magnetic line of the fourth magnetic pole 120*d*. The area where (i) the magnetic brush is created and (ii) the photoreceptor 3 and the developing sleeve 119 face each other is the developing area.

The fifth magnetic pole 120*e* is provided adjacent to the fourth magnetic pole 120*d* on the downstream side in the rotational direction of the developing sleeve 119. The fifth magnetic pole 120*e* is the north pole. The developer carried from the position of the fourth magnetic pole 120*d* is held by the developing sleeve 119 by use of a magnetic line created by the fifth magnetic pole 120*e*, and then further carried toward downstream in the rotational direction of the developing sleeve 119.

The sixth magnetic pole 120*f* is provided adjacent to the fifth magnetic pole 120*e* on the downstream side in the rotational direction of the developing sleeve 119. The sixth magnetic pole 120*f* is the south pole. The developer carried from the position of the fifth magnetic pole 120*e* is held by the developing sleeve 119 by use of a magnetic line created by the sixth magnetic pole 120*f*, and then further carried to downstream in the rotational direction of the developing sleeve 119.

The seventh magnetic pole 120*g* is provided adjacent to the sixth magnetic pole 120*f* on the downstream side in the rotational direction of the developing sleeve 119. The seventh magnetic pole 120*g* is the north pole. The seventh magnetic pole is identical with the first magnetic pole 120*a* in magnetic polarity (according to the present embodiment, the north pole). No magnetic pole is provided in an area 127, on the developing sleeve 119, between the seventh magnetic pole 120*g* and the first magnetic pole 120*a*, and therefore no magnetic line is created in the area 127. Accordingly, the developer held by the seventh magnetic pole 120*g* is released from the developing sleeve 119 in the area 127. For this reason, the area 127 is referred to as "developer releasing region 127". The developer (residual developer) is released from the developing sleeve 119 in the developer releasing region 127 so as to be collected into the developing tank 111.

As illustrated in FIG. 1, a center of the developer releasing region 127 is such that (i) a center of the magnet fixing shaft 126 and a center of the second carrying member 113 are connected to each other via a straight line, (ii) the straight line is inclined to an upstream direction of the rotational direction of the developing sleeve 119 by "θ", and (iii) a point of the developing sleeve 119, through which the straight line extends, is the center of the developer releasing region. According to the present embodiment, "θ" is approximately an angle of 60°. Note that, according to the present embodiment, the developer releasing region 127 has the same magnetic polarity as those of its neighboring magnetic poles (upstream and downstream magnetic poles), and has a magnetic power of 5 mT or less.

The permeability sensor 118 is provided, below the second carrying member 113, on a bottom surface of the developing tank 111, so that a sensor surface of the permeability sensor 118 is exposed inside the developing tank 111 (see FIG. 1). The permeability sensor 118 is electrically connected to toner density control means (not illustrated). The toner density control means controls the toner discharge member 122 illustrated in FIG. 3 to rotate in accordance with a toner density measurement value detected by the permeability sensor 118, so as to supply a toner into the developing tank 111 via the toner discharge opening 123.

In a case where the toner density control means determines that a toner density measurement value measured by the permeability sensor 118 is less than a toner density setting value, the toner density control means transmits a control signal to driving means for driving the toner discharge member 122 to rotate, so as to drive the toner discharge member 122 to rotate.

A general permeability sensor can be used as the permeability sensor 118. Examples of the permeability sensor 118 encompass a transmitted light detecting sensor, a reflected light detecting sensor, and a permeability detecting sensor. Among these, the permeability detecting sensor is preferably used as the permeability sensor 118.

The permeability detecting sensor outputs, as an output voltage value, a result of detection of a toner density in response to application of a control voltage. Sensitivity of such a permeability detecting sensor is basically high in the vicinity of a central value of its output voltage. For this reason, the control voltage thus applied is such a voltage that an output voltage in the vicinity of the central value can be obtained. For the application of the voltage, the permeability detecting sensor is connected to a power source (not illustrated). The power source applies, to the permeability detecting sensor, (i) a driving voltage for driving the permeability detecting sensor and (ii) the control voltage for outputting a result of detection of a toner density to the control means. The application of a voltage to the permeability detecting sensor by the power source is controlled by the control means. Such a permeability detecting sensor is commercially-available. Examples of the permeability detecting sensor encompass TS-L, TS-A, and TS-K (each of which is a product name) (manufactured by TDK Corporation).

Next, the following description deals with how the developer is carried in the developing tank 111 of the developing device 2.

A toner stored in the toner supply device 22 is carried into the developing tank 111 via the toner transfer mechanism 102 and the toner supply opening 115*a* (see FIGS. 1 through 3). In this manner, the toner is supplied to the developing tank 111. The toner supply opening 115*a* is formed in the first carrying path P so as to be in the downstream with respect to the second communicating path 117*b* in the direction in which the developer is carried (see FIGS. 5 and 6). The toner is supplied to the first carrying path P via the toner supply opening 115*a*.

In the developing tank 111, the first carrying member 112 and the second carrying member 113 are driven to rotate by driving means (not illustrated), such as a motor, so as to carry the developer. Specifically, the developer is carried, by the first carrying member 112, in the first carrying path P in a direction indicated by an arrow X to the first communicating path 117*a*, while being stirred by the first carrying member 112. After reaching the first communicating path 117*a*, the developer is further carried to the second carrying path Q through the first communicating path 117*a*. Then, in the second carrying path Q, the developer is carried, by the second carrying member 113, in a direction indicated by an arrow Y to the second communicating path 117*b*, while being stirred by the second carrying member 113. After reaching the second communicating path 117*b*, the developer is returned to the first carrying path P through the second communicating path 117*b*.

That is, the first carrying member 112 and the second carrying member 113 carries the developer in directions opposite to each other, independently, while they stir the developer. The first carrying member 112 carries the developer in the direction indicated by the arrow X, whereas the second carrying member 113 carries the developer in the direction indicated by the arrow Y, which is opposite to the direction indicated by the arrow X (see FIG. 5).

As described above, the developer is circulated, in the developing tank 111, through the first carrying path P, the first communicating path 117*a*, the second carrying path Q, and the second communicating path 117*b*, in this order. In other words, the developing device 2 is a circulation-type developing device that circulates the developer through a circulation path constituted by the first carrying path P and the second carrying path Q. The developer is scooped up and held on the surface of the developing roller 114 by the rotation of the developing roller 114, when being carried through the second carrying path Q. Then, the toner in the developer scooped by the developing roller 114 is transferred from the developing sleeve 119 to the photoreceptor 3. In this manner, the toner is consumed sequentially.

An unused toner is supplied to the first carrying path P via the toner supply opening 115*a*, so as to make up for the toner sequentially consumed. The unused toner supplied to the first carrying path P is stirred together with the toner that has been in the first carrying path P earlier than the unused toner, so as to be mixed with the toner.

<Doctor Blade>

Next, the following description deals with the doctor blade 116 in accordance with the present embodiment of the present invention.

Figure 8:
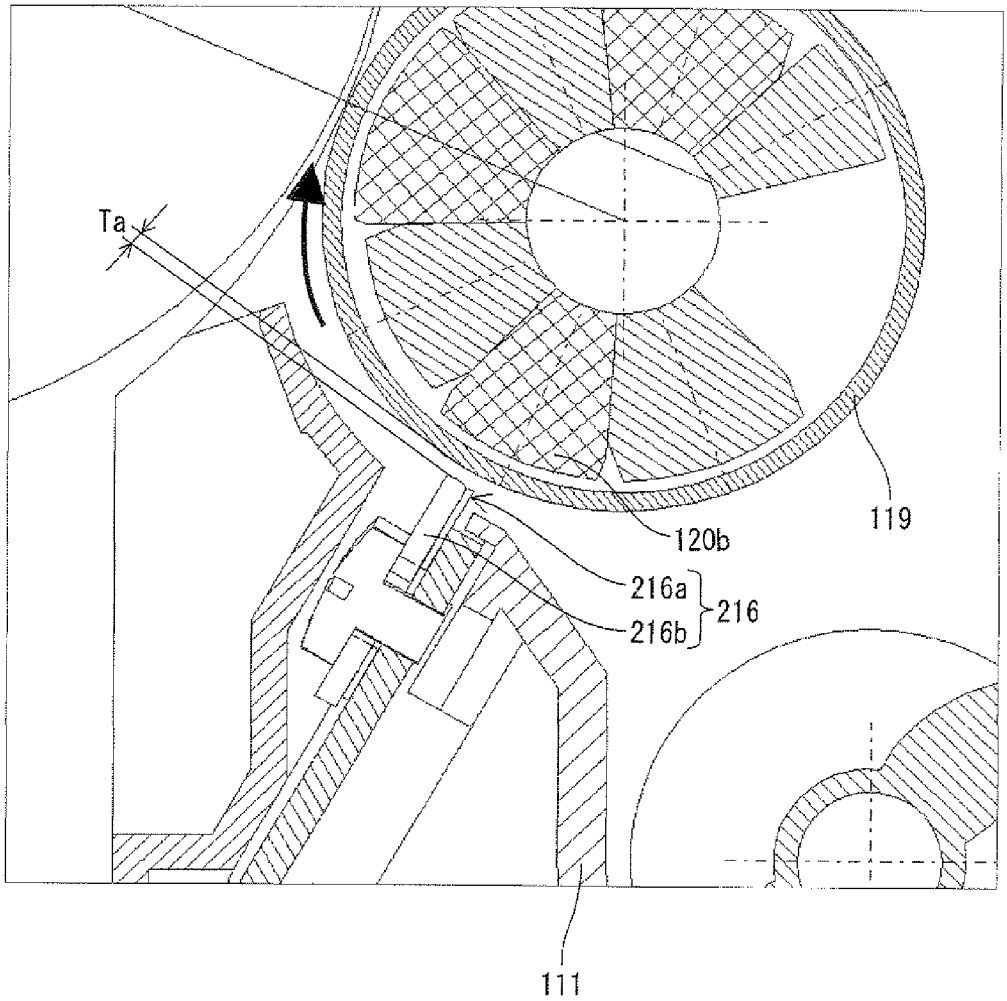
FIG. 8 is an enlarged cross-sectional view illustrating a part of a conventional developing device, which part includes a conventional doctor blade.
Figure 9:
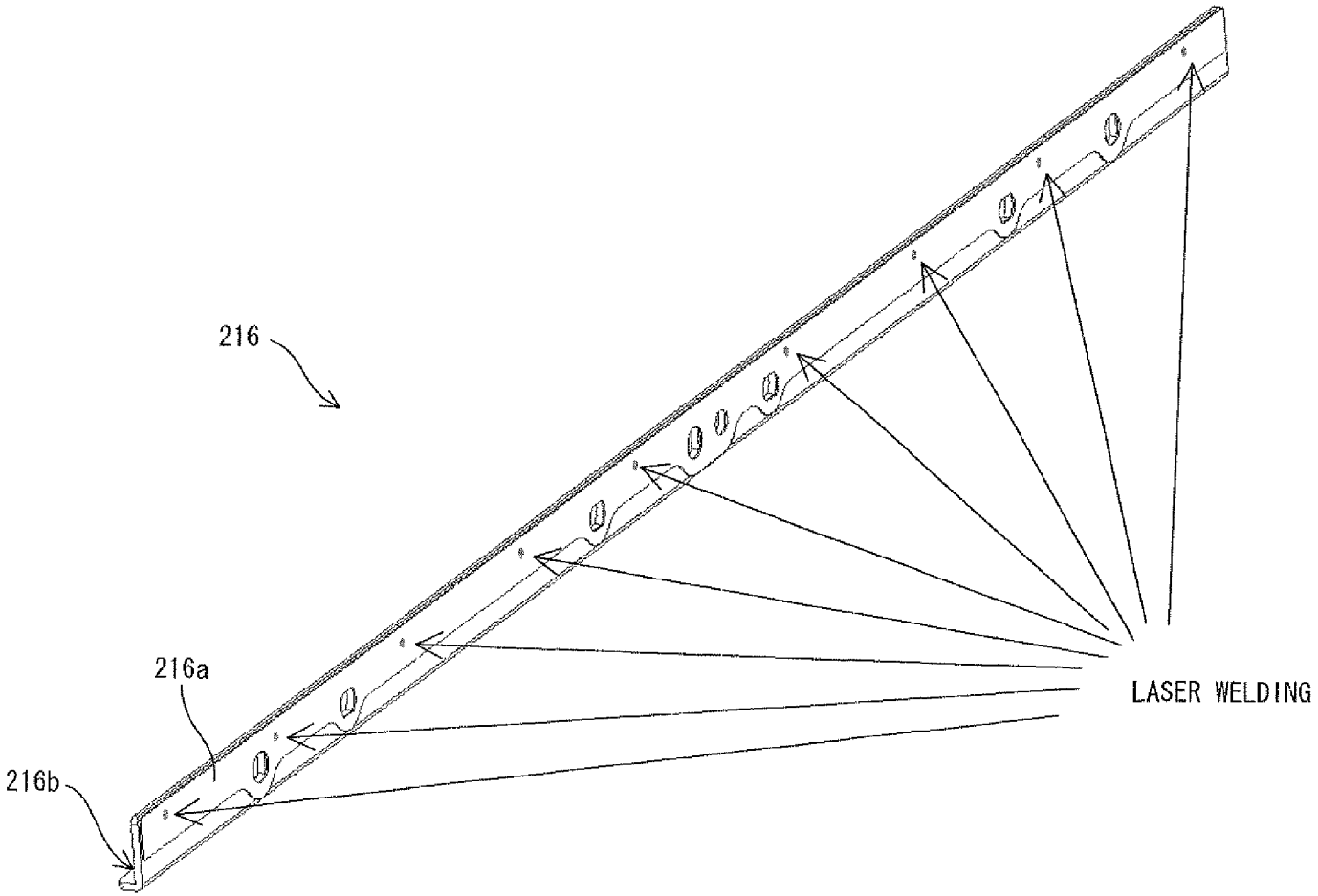
FIG. 9 is a perspective view illustrating an arrangement of the conventional doctor blade.

First, a conventional doctor blade is described below. A conventional doctor blade 216 is a plate member provided to extend in parallel with an axial direction of the developing sleeve 119 (see FIG. 8). The doctor blade 216 is provided to face the second magnetic pole 120*b* via the developing sleeve 119. The doctor blade 216 causes the developer captured on the surface of the developing sleeve 119 to be uniform in thickness so as to control an amount of the developer to be supplied to the photoreceptor 3.

The conventional doctor blade 216 is constituted by, for example, (i) a magnetic member (magnetic stainless-steel plate) 216*a* (such as SUS 430 having a plate thickness of, for example, 0.3 mm), serving as a main doctor blade, and (ii) a non-magnetic member (non-magnetic stainless-steel plate) 216*b* (such as non-magnetic SUS 304 having a plate thickness of, for example, 1.2 mm), serving as a sub-doctor plate. The magnetic member 216*a* and the non-magnetic member 216*b* are stacked with each other so that (i) the magnetic member 216*a* is provided on an upstream side in the direction in which the developer is carried by the developing sleeve 119 and (ii) the non-magnetic member 216*b* is provided on a downstream side in such a direction. Further, the main doctor blade 216*a* and the sub-doctor blade 216*b* are stacked with each other by laser welding so that the conventional doctor blade 216 is improved in strength and accuracy. The conventional doctor blade 216 is fixed to the developing tank 111 so that a predetermined gap (doctor gap) Ta between the surface of the developing sleeve 119 and the doctor blade 216 is adjusted to be in a range of, for example, not less than 0.6 mm but not more than 1.0 mm.

Figure 7:
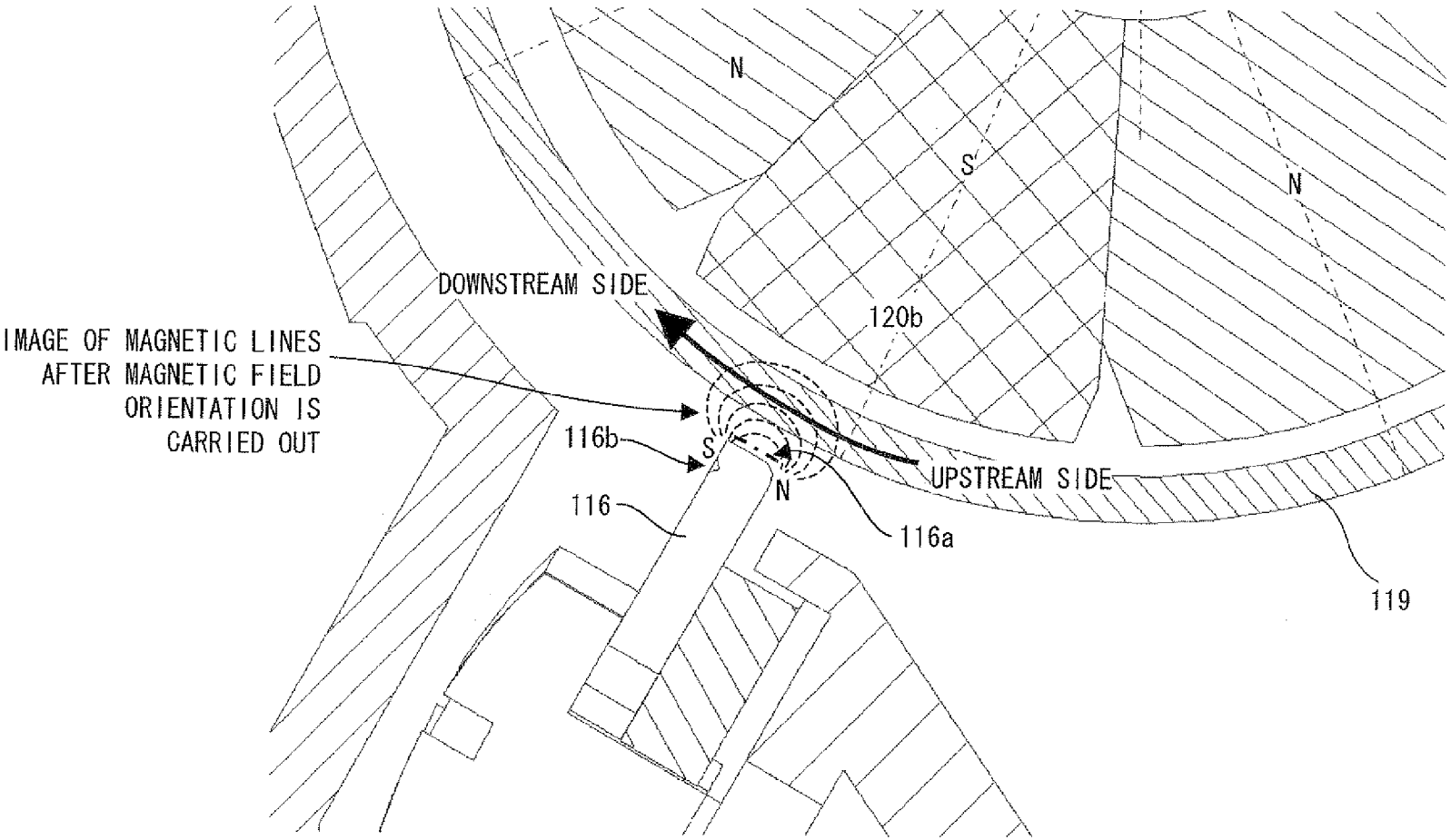
FIG. 7 is an enlarged cross-sectional view illustrating a part of the developing device illustrated in FIG. 1, which part includes a doctor blade.

FIG. 7 is a cross-sectional view illustrating the doctor blade 116 in accordance with the present embodiment of the present invention, which doctor blade 116 is attached to the developing device 2.

Unlike the conventional doctor blade 216 described above, the doctor blade 116 of the present embodiment is not constituted by a combination of the magnetic stainless-steel plate and the non-magnetic stainless-steel plate but only the non-magnetic stainless-steel plate (SUS 304). Note that the doctor blade 116 of the present embodiment has a plate thickness of 1.5 mm, but the plate thickness is not limited to this. It is preferable that the doctor blade 116 has a plate thickness in a range of 1.0 mm to 2.0 mm, for example.

The doctor blade 116 is provided to extend in parallel with the axial direction of the developing sleeve 119 in the same manner as the conventional doctor blade 216. The doctor blade 116 is provided to face the second magnetic pole 120*b* via the developing sleeve 119. The doctor blade 116 causes the developer captured on the surface of the developing sleeve 116 to be uniform in thickness so as to control an amount of the developer to be supplied to the photoreceptor 3.

Here, the doctor blade 116 is provided in the downstream in the rotational direction of the developing sleeve 119 with respect to a central line of the second magnetic pole 120*b*. This arrangement allows the amount of the developer, carried on the surface of the developing sleeve 119, to be stable.

It is also possible to arrange the doctor blade 116 to face, for example, the third magnetic pole 120*c*. However, in this case, there arises such a layout problem that the doctor blade 116 and the photoreceptor 3 are too close to each other. Therefore, it is preferable to arrange the doctor blade 116 to face the second magnetic pole 120*b* so that the doctor blade 116 cuts off an excess developer in a position where the doctor blade 116 and the second magnetic pole 120*b* face each other.

The doctor blade 116 is a non-magnetic member, and its nearest part (end section 116*a*) from the developing roller 114 (i) has been caused to be ferromagnetic and (ii) has been magnetic-field orientated. Since (i) the doctor blade 116 is the non-magnetic member and (ii) the nearest part of the non-magnetic member from the developing roller 114 has been caused to be ferromagnetic and has been magnetic-field oriented, a mass of the doctor blade 116 has no influence on a magnetic field between the doctor blade and the second magnetic pole 120*b*. This suppresses generation of phenomena such as torque-up and toner-spent. Note that in a case where the entire doctor blade 116 is made of a magnetic material, magnetic force of the magnetic pole 120*b* that faces the doctor blade 116 has an influence on even parts other than the nearest part (end section). In this case, flow of the developer becomes less fluent, and therefore torque-up is generated.

Further, the doctor blade 116 is juxtaposed to the developing roller 114 along the axial direction of the magnet fixing shaft 126. This makes it possible for the doctor blade 116 to efficiently cut off an excess developer out of the developer provided on the developing sleeve 119 so that the developer on the developing sleeve 119 becomes uniform in thickness after passing the doctor blade 116.

As described above, the developing device 2 can (i) reduce (suppress) stress on the developer with a simple arrangement and (ii) have high productivity without an increase in production cost. Further, since deterioration of the developer can be suppressed, it is possible to provide images while stably ensuring image quality for a long term.

According to the present embodiment, the doctor blade 116 is made of an anti-ferromagnetic austenite stainless-steel plate, and the end section (the nearest part) 116*a*, which is the nearest part of the doctor blade 116 from the developing roller 114, has been (i) caused to be ferromagnetic by martensite transformation which was induced by carrying out an inducing process, and then (ii) magnetic-field oriented. Here, in order to cause the end section 116*a* to be ferromagnetic, a polishing process is carried out, as the inducing process, with respect to an outer fracture surface of the end section 116*a*. Further, the doctor blade 116 is magnetic-field oriented in such a manner that (i) the doctor blade 116 is set to a magnetizing device and (ii) a magnetic field is applied to the end section 116*a* of the doctor blade 116.

The polishing process is carried out, as the inducing process, with respect to the outer fracture surface of the end section 116*a* of the doctor blade 116, which outer fracture surface is to face (i.e., a so-called control gap is formed between the outer fracture surface and the developing sleeve 119) the developing sleeve 119. This smoothes the outer fracture surface, so as to induce magnetization of the end section 116*a*. Further, the polishing process also has an effect of causing differences in magnetization degree of the doctor blade 116 in its longitudinal direction (the axial direction of the magnet fixing shaft 126) to be eliminated. Note that a fracture shape, i.e., the outer fracture surface, is formed because the doctor blade 116 is formed through a pressing process and a cutting-out process.

SUS 304 is a commonly-available material. In a case where SUS 304 is used as the anti-ferromagnetic austenite stainless-steel in formation of the doctor blade 116, it is therefore possible to suppress an increase in cost. Further, since it is easy to process the SUS 304, it is possible to stably ensure component quality in production of the doctor blade 116.

Here, the end section 116*a* of the doctor blade 116 has been magnetic-field oriented and has different magnetic polarities in a plate thickness direction of the doctor blade 116 (see FIG. 7). That is, (i) the end section 116*a* has, on an upstream side in a direction in which the developer is carried by the developing sleeve 119, a magnetic polarity (the north pole in the present embodiment) opposite to that of the second magnetic pole 120*b* facing the end section 116*a*, and (ii) the end section 116*a* has, on a downstream side in the direction in which the developer is carried by the developing sleeve 119, a magnetic polarity (the south pole in the present embodiment) identical with that of the second magnetic pole 120*b*.

As described above, the doctor blade 116 has, on the upstream side in the direction in which the developer is carried by the developing roller 114, the magnetic polarity opposite to that of the second magnetic pale 120*b* facing the doctor blade 116, while having, on the downstream side, the magnetic polarity identical with that of the second magnetic pole 120*b*. With the arrangement, it is possible to smoothly control the thickness of the developer without employing an arrangement of a conventional developing device, in which the magnetic member 216*a* and the non-magnetic member 216*b* are combined with each other.

Further, for the magnetization of the end section 116*a*, it is possible to carry out, as the inducing process, a groove forming process through which a groove cut-out section (grove section) is formed in the vicinity of the end section 116*a*, instead of carrying out the polishing process with respect to the end section 116*a*. This allows the magnetic-field orientation of the end section 116*a* to be carried out more successfully. The groove forming process can be carried out in such a manner that a corresponding part of the doctor blade 116 is pressed and punched.

With the arrangement in which the cut-out section 116*b* is formed in the vicinity of the end section 116*a* of the doctor blade 116 by carrying out, as the inducing process, the groove forming process, it is possible to make it clear (i) which part of the doctor blade 116 is a magnetized part and (ii) which part of the doctor blade 116 is a non-magnetic part. This allows further enhancement in the magnetization of the end section 116*a*, and therefore stabilizes the magnetic field orientation. It is thus possible to have an effect of causing a layer thickness (an amount of the developer to be carried) of the developer to be constant, which developer passes the end section 116*a*.

In order to cause the end section 116*a* to be ferromagnetic, the inducing process can be carried out in any one of the following three manners.

1. Only the formation of the cut-out section 116*b* is carried out.
2. Only the polishing of the end section 116*a* is carried out.
3. Both the polishing of the end section 116*a* and the formation of the cut-out section 116*b* are carried out.

Further, it is preferable that (i) both ends of the doctor blade 116 in the axial direction of the magnet fixing shaft 126 are positioned inward with respect to corresponding ends of the magnet roller 120 in the axial direction of the magnet fixing shaft 126, while (ii) both ends of the doctor blade 116 are positioned outward with respect to respective positions indicating a maximum allowable width for a sheet used in the image forming apparatus 100 including the developing device 2. By arranging the doctor blade 116 so that the ends of the doctor blade 116 are positioned as described above in the axial direction of the magnet fixing shaft 126, it is possible to stabilize a magnetic field at each of the ends of the doctor blade 116, at which the magnetic field tends to be unstable. It is thus possible to prevent the developer or the toner from scattering.

Furthermore, the doctor blade 116 is fixed to the developing tank 111 in the same manner as the conventional doctor blade 216 (see FIG. 1). According to the present embodiment, the gap (doctor gap) between the doctor blade 116 and the surface of the developing sleeve 119 is adjusted to be in a range of not less than 0.6 mm but not more than 1.0 mm. Here, in order to achieve high image quality, it is preferable that an image is visualized while the developer is provided as thin as possible on the developing sleeve 119. For this reason, it is desirable that the doctor gap should be set as narrow as possible (e.g., 0.5 mm or less). However, as the doctor gap becomes narrower, stress on the developer passing the doctor blade 116 tends to be greater. In view of such conditions, the arrangement of the present embodiment described above makes it possible to provide the developer as a thin film while setting the doctor gap relatively wide.

As described above, the developing device 2 of the present embodiment can reduce the stress on the developer with an arrangement that is simpler than that of the conventional arrangement.

Further, as described above, the image forming apparatus 100 of the present embodiment includes the developing device 2 that can reduce the stress on the developer. This allows the image forming apparatus 100 to form images, while stably ensuring high image quality by suppressing deterioration of the developer for a long term.

Note that, in the aforementioned descriptions, the developing device 2 of the present invention is employed in the image forming apparatus 100 illustrated in FIG. 2. However, the developing device 2 is not limited to the use in the image forming apparatus or a copier having the aforementioned arrangement. The developing device 2 can be employed in any image forming apparatus or the like, provided that the image forming apparatus includes such a developing device that (i) a developer stirred in the developing tank 111 is held on the developing roller 114, and (ii) a layer thickness of the developer is controlled by a doctor blade.

<Carrier>

The present embodiment preferably uses a carrier having a 50% particle size (D50) based on volume which particle size falls within a range from 15 to 70 μm. The D50 falls more preferably within a range from 25 to 60 μm, and even more preferably within a range 30 to 55 μm.

In a case where the D50 of the carrier is less than 15 μm, the developer, although forming an even and dense brush on the development sleeve 119, forms a short magnetic brush chain. As such, it is necessary to provide a gap (developing area) between the photoreceptor 3 and the development sleeve 119 which gap is extremely small (for example, in a range from 0.1 to 0.3 mm). As a result, a very expensive developing device is required. There is a tendency that (i) the developer has a decreased fluidity and that (ii) supplied toner has a poor rise of charging. Further, in the case where the D50 is less than 15.0 μm, particles of the carrier are likely to be attached to the photoreceptor 3 due to an image charge between the photoreceptor 3 and the carrier. This may prevent stable formation of a toner layer on the development sleeve 119, or cause a small scratch on the photoreceptor 3.

In contrast, in a case where the D50 of the carrier exceeds 70 μm, the developer forms by magnetism a long brush, which causes nonuniform brushing (that is, a uniform magnetic brush chain is not formed easily, so that the developer consequently has a rough surface). This problem tends to decrease image quality. Further, the carrier has a small specific surface area, so that it is impossible to sufficiently charge toner. The magnetic brush chain also tends to be rigid. As such, there may occur nonuniform brushing in a developer layer on the development sleeve 119, and consequently, an image of good quality may not be formed.

The carrier of the present embodiment more preferably has a true specific gravity which falls within a range from 3.0 to 3.8 g/cm$^3$. A developer containing a carrier having a true specific gravity within the above range has only a small load on the toner even when the carrier is stirred and mixed with the toner, and toner-spent on the carrier is prevented. Further, a carrier having a true specific gravity within the above range is preferable in that it allows a good toner layer to be formed on the development sleeve 119 and that even if it is attached to the development sleeve 119 or the photoreceptor 3, the carrier is not likely to damage the photoreceptor 3.

With the true specific gravity of the carrier within the above range, in a case where a mixture of a toner and a carrier is used as a supply (so called trickle development system), a developer can desirably be supplied in a stable manner. As such, the sliding member 128 of the present embodiment can also be arranged for use in a developing device employing the trickle development system. In the trickle development system, a developer in the developing tank has properties which are similar, in terms of both specific gravity and fluidity, to those of a developer to be supplied (including a toner and a carrier which have been mixed in advance). As such, it is possible to stably supply a developer as compared to a case of supplying only toner.

The true specific gravity of the carrier for use in the present embodiment can be adjusted by adjusting production conditions such as a kind of a material, a material composition ratio, and a burning temperature for a core production.

The carrier for use in the present embodiment has a magnetization intensity ($\sigma 1000$) measured in a magnetic field of $1000/4\pi$ (kA/m) (1000 oersteds) which magnetization intensity falls preferably within a range from 40 to 70 $Am^2/kg$, more preferably within a range from 50 to 70 $Am^2/kg$, and even more preferably within a range from 55 to 65 $Am^2/kg$.

In a case where the carrier has a magnetization intensity ($\sigma 1000$) within the above range, the carrier is prevented from being attached to the development sleeve 119 or the photoreceptor 3. As such, a developer containing the carrier has an improved durability in use.

In a case where the carrier has a magnetization intensity ($\sigma 1000$) which exceeds 70 $Am^2/kg$, there is a large stress on toner in a magnetic brush chain formed of the developer, and the toner is thus likely to be degraded. Further, the carrier is likely to be subjected to toner-spent. In a case where the carrier has a magnetization intensity ($\sigma 1000$) which is less than 40 $Am^2/kg$, the carrier has only a weak magnetic bond to the development sleeve 119. As such, even if the carrier is substantially spherical, it is likely to be attached to the development sleeve 119 or the photoreceptor 3, and a voltage for removing background photographic fog may be narrowed in latitude.

The magnetization intensity of the carrier for use in the present embodiment can be adjusted by appropriately selecting a kind and amount of a magnetic substance to be contained.

The magnetization intensity of the carrier for use in the present embodiment can be measured, for example, with use of oscillating magnetic field type magnetic property automatic recorder BHV-30 of Riken Denshi Co., Ltd. through the following steps: First, a carrier is filled into a cylindrical plastic container at a sufficient density. In the meantime, an external magnetic field of $1000/4\pi$ (kA/m) (1000 oersteds) is applied to the container. In this state, a magnetic moment of the carrier filled in the container is measured. Then, an actual mass of the carrier filled in the container is measured to determine a magnetization intensity ($Am^2/kg$) of the carrier.

The carrier for use in the present embodiment preferably includes a carrier core which is a porous core containing ferrite, because such a carrier core is excellent in productivity. A ferrite-containing carrier core, even if it contains a large amount of resin so as to be low in density, has resin impregnated in pores thereof, and desirably has an improved adhesiveness due to an added resin layer. A "porous carrier core" as described herein refers to a core having pores internally or superficially.

The above core can be prepared by, for example, (i) lowering a burning temperature so as to reduce growth of crystal or (ii) adding a pore forming agent such as a foaming agent so as to form pores in the core. A method for preparing the core is, however, not limited to the above.

<Transparent Toner>

The toner for use in the present embodiment can include a transparent toner. A transparent toner is held on a surface of a recording sheet, and a colored toner is then provided over the transparent toner. This reduces influence of unevenness of the surface of a recording sheet, and improves color reproducibility and gloss with use of a smaller amount of a colored toner. It follows that it is possible to form a colored toner image having a higher resolution. In this case, a transparent toner is first laminated with a recording sheet so that unevenness on the surface of the recording sheet is buried underneath.

The transparent toner of the present embodiment is a toner made of a resin which is high in light-transmitting property and which substantially contains no coloring agent. The transparent toner is preferably made up of particles which has a number average particle size that falls within a range from 1 to 25 μm, which is substantially colorless, and which transmits at least visible light well without substantially scattering it.

The transparent toner can include any additional component according to need. In a case where, for example, the transparent toner additionally includes a wax, a fatty acid, or a metal salt of a fatty acid, a uniform film is easily formed when the transparent toner is fused so as to be fixed. This improves transparency of the transparent toner, and thus forms a color image which has an excellent surface gloss. Further, it is also possible to prevent offset when an image is fixed with use of a heat roller. The transparent toner can include, other than the above, an external additive such as silica, alumina, titania, and organic resin particles so as to ensure that the toner is fluid and capable of being charged.

<Colored Toner>

The present embodiment uses four colored toners (namely, yellow, magenta, cyan, and black) so as to form images of the four colors. The colors are, however, not particularly limited to the above four colors. The colored toners can be of six colors including, other than the above four, colors such as light cyan (LC), which is identical in hue to cyan and lower in concentration than cyan, and light magenta (Lm), which is identical in hue to magenta and lower in concentration than magenta. The colored toners can each have a number average particle size which falls within a range from, for example, 1 to 25 μm.

The present embodiment adjusts a weight of toner contained in a region of a transferred image having an image area rate of 100% which weight falls within a range from 0.20 to 0.40 $mg/cm^2$. In a case of a transferred image of a process black (obtained by overlapping images of the three colors yellow, cyan, and magenta), the present embodiment adjusts the weight of toner contained in a region of a transferred image having an image area rate of 100% so that the weight falls within a range from 0.6 to 1.2 $mg/cm^2$.

In a case where the toner weight is less than 0.20 mg, it is impossible to achieve a sufficient image density. In a reverse case where the toner weight is greater than 0.40 mg, a large amount of toner of the developer substantially needs to be supplied to the photoreceptor 3, and an amount of toner consumption is greater. As a result, there may be a decrease in efficiency in transferring toner from the photoreceptor 3 to the intermediate transfer belt 7 having no ends. In this case, an additional toner of the developer may be required.

The present embodiment uses a toner which can be produced by a production normal method such as a grinding method, suspension polymerization, emulsion polymerization, solution polymerization, and ester elongation polymerization.

<Arrangements of Present Invention>

A developing device of the present invention includes: a developing tank for containing a developer including a toner and a carrier; a developing roller including a developing sleeve and a magnet roller, the developing sleeve (i) being provided rotatable and (ii) having a cylinder shape, the magnet roller being constituted by a plurality of magnetic poles, the plurality of magnetic poles being fixed to a fixing shaft inside the developing sleeve so that neighboring ones of the plurality of magnetic poles have opposite magnetic polarities, the developing roller (I) capturing, on a surface of the developing sleeve, by magnetic force of the magnet roller, the developer contained in the developing tank, and (II) supplying the developer captured on the surface of the developing sleeve to an image bearing member which is provided to face the developing roller; and a control member for controlling an amount of the developer to be supplied to the image bearing member by causing the developer captured on the surface of the developing sleeve to be uniform in layer thickness, the control member being provided to face, via the developing sleeve, one of the plurality of magnetic poles, the control member being a non-magnetic member provided in parallel with the developing roller in an axial direction of the fixing shaft, the non-magnetic member being such that a nearest part of the non-magnetic member from the developing roller (i) has been caused to be ferromagnetic and (ii) has been magnetic-field oriented.

According to the arrangement, it is possible to provide a developing device which can (i) reduce (suppress stress on a developer with a simple arrangement, and (ii) have high productivity without an increase in production cost.

Here, the developing device of the present invention may be arranged such that the non-magnetic member is an anti-ferromagnetic austenite stainless-steel plate, and the nearest part of the non-magnetic member from the developing roller, first, (i) has been caused to be ferromagnetic by martensite transformation which is caused by an inducing process, and then (ii) has been magnetic-field oriented.

In addition to the arrangement, the developing device of the present invention may be arranged such that the anti-ferromagnetic austenite stainless-steel plate of the control member is made of SUS 304.

According to the arrangement, since SUS 304 constituting the control member is a commonly-available material, it is possible to suppress an increase in cost. Further, since it is easy to process SUS 340, it is possible to stably ensure component quality.

In addition to the arrangement, the developing device of the present invention may be arranged such that a groove forming process is carried out as the inducing process so that a groove section is formed in the vicinity of the nearest part of the control member from the developing roller.

According to the arrangement, the groove section is formed, by the groove forming process, in the vicinity of the nearest part of the control member from the developing roller. The formation of the groove section makes it clear (i) which part of the control member is a magnetized part and (ii) which part of the control member is a non-magnetic part. This allows further enhancement in the magnetization of the nearest part, and therefore stabilizes magnetic field orientation. It is thus possible to cause a layer thickness (an amount of the developer to be carried) of the developer that passes the nearest part to be constant.

Here, a pressing process can be carried out as the groove forming process, for example. In this case, it is possible to easily form the groove section in the vicinity of the nearest part of the control member from the developing roller.

In addition to the arrangement, the developing device of the present invention may be arranged such that a polishing process is carried out as the inducing process so that an outer fracture surface of the control member is polished, which outer fracture surface faces the developing sleeve.

According to the arrangement, the polishing process is carried out as the inducing process for the nearest part of the control member from the developing roller so that the outer fracture surface of the control member, facing (i.e., a so-called a control gap is formed) the developing sleeve, is polished. This smoothes the fracture shape, so as to accelerate the magnetization. In addition, it is possible to cause differences in magnetization degree of the control member in a longitudinal direction (an axial direction of the fixing shaft of the developing roller) to be eliminated. Note that the fracture shape, i.e., the fracture surface, is formed because the control member is formed through a pressing process and a cutting-out process.

In addition to the arrangement, the developing device of the present invention is preferably arranged such that the nearest part of the control member from the developing roller has been magnetic-field oriented so that the nearest part has (i), on an upstream side in a direction in which the developer is carried by the developing roller, a magnetic polarity opposite to that of the one of the plurality of magnetic poles, facing the control member, and (ii), on a downstream side in the direction in which the developer is carried by the developing roller, a magnetic polarity identical with that of the one of the plurality of magnetic poles.

According to the arrangement, the nearest part of the control member has (i), on the upstream side in the direction in which the developer is carried by the developing roller, the magnetic polarity opposite to that of the magnetic pole facing the nearest part, and (ii), on the downstream side, the magnetic polarity identical with that of the magnetic pole facing the nearest part. This makes it possible to have an effect of smoothly controlling a layer thickness of the developer, even without employing an arrangement of a conventional developing device, in which a magnetic member and a non-magnetic member are combined with each other.

In addition to the arrangement, the developing device of the present invention is preferably arranged such that ends of the control member in the axial direction of the fixing shaft are positioned inward with respect to corresponding ends of the magnet roller in the axial direction of the fixing shaft, while being positioned outward with respect to respective positions indicating a maximum allowable width for a sheet used in an image forming apparatus including the developing device.

According to the arrangement, the ends of the control member in the axial direction of the fixing shaft of the developing roller are positioned inward with respect to the corresponding ends of the magnet roller in the axial direction of the fixing shaft of the developing roller, while being positioned outward with respect to the respective positions indicating a maximum allowable width for a sheet used in the image forming apparatus including the developing device. By arranging the control member so that the ends of the control member are positioned as described above in the axial direction of the fixing shaft of the developing roller, it is possible to stabilize a magnetic field at each of the ends of the doctor blade 116, at which the magnetic field tends to be unstable. It is thus possible to prevent the developer or the toner from scattering.

An image forming apparatus of the present invention, includes: an image bearing member having a surface on which an electrostatic latent image is formed; a charging device for charging the surface of the image bearing member; an exposure device for forming the electrostatic latent image on the surface of the image bearing member; a developing device for forming a toner image by supplying a toner to the electrostatic latent image; a transfer device for transferring the toner image formed on the surface of the image bearing member to a recording material; and a fixing device for fixing, on the recording material, the toner image transferred to the recording material, the developing device being any one of the developing devices described above.

According to the arrangement, the image forming apparatus of the present invention includes the developing device of the present invention, which can reduce the stress on the developer. This allows the image forming apparatus to suppress deterioration of the developer. It is thus possible to provide images while stably ensuring high image quality for a long term.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is applicable to: a developing device for use in an electrophotographic image forming apparatus such as a printer, a copier, a facsimile, or an MFP (Multi Function Printer), which developing device employs a two-component developer containing a toner and a magnetic carrier.

REFERENCE SIGNS LIST

2: Developing device
3: Photoreceptor (image bearing member)
100: Image forming apparatus
111: Developing tank (developer container section)
112: First carrying member
112*a*: First carrying blade
112*b*: First rotational shaft
113: Second carrying member
113*a*: Second carrying blade
113*b*: Second rotational shaft
114: Developing roller
115: Developing tank cover
115*a*: Toner supply opening
116: Doctor blade (control member)
116*a*: End section (nearest part)
116*b*: Cut-out section (groove section)
117: Partition wall
118: Permeability sensor
119: Developing sleeve
120: Magnet roller
121: Toner container
122: Toner discharge member
123: Toner discharge opening
124: Toner discharge member blocking wall
125: Toner stirring member
126: Magnet fixing shaft
127: Developer releasing region
134: Toner discharge member driving motor
216: Conventional doctor blade
216*a*: Magnetic member
216*b*: Non-magnetic member
P: First carrying path
Q: Second carrying path

The invention claimed is:

1. A developing device comprising:

a developing tank for containing a developer including a toner and a carrier;

a developing roller including a developing sleeve and a magnet roller, the developing sleeve (i) being provided rotatable and (ii) having a cylinder shape, the magnet roller being constituted by a plurality of magnetic poles, the plurality of magnetic poles being fixed to a fixing shaft inside the developing sleeve, the developing roller (I) capturing, on a surface of the developing sleeve, by magnetic force of the magnet roller, the developer contained in the developing tank, and (II) supplying the developer captured on the surface of the developing sleeve to an image bearing member which is provided to face the developing roller; and a control member for controlling an amount of the developer to be supplied to the image bearing member by causing the developer captured on the surface of the developing sleeve to be uniform in layer thickness, the control member being provided to face, via the developing sleeve, one of the plurality of magnetic poles, the control member provided in parallel with the developing roller in an axial direction of the fixing shaft, the control member originally being an entirely non-magnetic member, the control member being such that only a nearest part of the control member from the developing roller has been caused to be ferromagnetic and has been magnetic-field oriented so that the nearest part has (i), on an upstream side in a direction in which the developer is carried by the developing roller, a magnetic polarity opposite to that of the one of the plurality of magnetic poles facing the control member, and (ii), on a downstream side in the direction in which the developer is carried by the developing roller, a magnetic polarity identical with that of the magnetic pole facing the control member.

2. The developing device as set forth in claim 1, wherein:

the non-magnetic member was originally an anti-ferromagnetic austenite stainless-steel plate; and the nearest part of the non-magnetic member from the developing roller, first, (i) has been caused to be ferromagnetic by martensite transformation which was caused by an inducing process, and then (ii) has been magnetic-field oriented.

3. The developing device as set forth in claim 2, wherein:

the anti-ferromagnetic austenite stainless-steel plate of the control member is made of SUS 304.

4. The developing device as set forth in claim 2, wherein:

a groove forming process is carried out as the inducing process so that a groove section is formed in the vicinity of the nearest part of the control member from the developing roller.

5. The developing device as set forth in claim 4, wherein:

a pressing process is carried out as the groove forming process.

6. The developing device as set forth in claim 2, wherein:

a polishing process is carried out as the inducing process so that an outer fracture surface of the control member is polished, which outer fracture surface faces the developing sleeve.

7. An image forming apparatus comprising:

an image bearing member having a surface on which an electrostatic latent image is formed;

a charging device for charging the surface of the image bearing member;

an exposure device for forming the electrostatic latent image on the surface of the image bearing member;

a developing device for forming a toner image by supplying a toner to the electrostatic latent image;

a transfer device for transferring the toner image formed on the surface of the image bearing member to a recording material; and a fixing device for fixing, on the recording material, the toner image transferred to the recording material, the developing device being a developing device recited in claim 1.

* * * * *